US005871424A

United States Patent [19]

Conner

[11] Patent Number: 5,871,424

[45] Date of Patent: Feb. 16, 1999

[54] PORTABLE APPARATUS FOR EXERCISING ABDOMINAL MUSCLES

[76] Inventor: Gary W. Conner, 1484 Fairway Dr., Newton, N.C. 28658

[21] Appl. No.: 90,819

[22] Filed: Jun. 4, 1998

Related U.S. Application Data

[63] Continuation-in-part of Ser. No. 710,169, Sep. 12, 1996, Pat. No. 5,766,118, and a continuation-in-part of Ser. No. 56,008, Apr. 6, 1998.

[60] Provisional application No. 60/008,814 Dec. 18, 1995.

[51] Int. Cl.[6] ..... A63B 00/69

[52] U.S. Cl. ..... 482/129; 482/904; 482/121

[58] Field of Search ..... 482/121–130, 482/904; 602/4; 5/89.1

[56] References Cited

U.S. PATENT DOCUMENTS

| | | | |
|---|---|---|---|
| 562,389 | 6/1896 | Gossweiler | 482/129 |
| 605,237 | 6/1898 | Spink | 482/129 |
| 1,432,013 | 10/1922 | Blake | 482/124 |
| 4,116,434 | 9/1978 | Bernstein . | |
| 4,762,318 | 8/1988 | Phillips . | |
| 4,909,505 | 3/1990 | Tee | 482/121 |
| 5,098,089 | 3/1992 | Harrington | 482/140 |
| 5,120,052 | 6/1992 | Evans | 482/145 |
| 5,167,601 | 12/1992 | Frappier | 482/121 |
| 5,250,016 | 10/1993 | Higgins | 482/121 |
| 5,254,064 | 10/1993 | Rock | 482/129 |
| 5,328,435 | 7/1994 | Ricks | 482/140 |

FOREIGN PATENT DOCUMENTS

| | | | |
|---|---|---|---|
| 0090 092 | 10/1983 | European Pat. Off. | 482/404 |
| 0016404 | 9/1900 | United Kingdom | 482/129 |
| 434067 | 8/1935 | United Kingdom | 482/124 |
| 2 227 949 | 8/1990 | United Kingdom | 482/129 |

*Primary Examiner*—Jerome W. Donnelly

[57] ABSTRACT

An exercise apparatus includes a clamping means for securing the apparatus to a conventional door, at least one elastic resistance band and a flexible resistance harness. The resistance harness includes a pair of arm slings made of a thin, relatively wide fabric material formed in a closed loop and defining an opening therethrough. The resistance harness further includes a connecting strap made of a thin, relatively narrow fabric material and having opposed ends. The opposed ends of the connecting strap are attached to the pair of arm slings such that the arm slings are connected by the connecting strap. The resistance harness further includes a chest strap made of a thin, relatively narrow fabric material and having opposed ends. The opposed ends of the chest strap are attached to the pair of arm slings opposite the connecting strap. The exercise apparatus is compact and lightweight and thus is convenient for individuals who travel frequently to use, transport and store. In a preferred method of using the exercise apparatus, a user extends the upper arms through the arm slings of the resistance harness and pulls the resistance harness using the abdominal muscles in the direction of the pelvis while bowing the lower back outwardly to extend the resistance band. Thus, the spine is elongated and all of the abdominal muscle groups are contracted without placing undue stress on the muscles in the lower back.

11 Claims, 1 Drawing Sheet

PORTABLE APPARATUS FOR EXERCISING ABDOMINAL MUSCLES

CROSS REFERENCE TO RELATED APPLICATIONS

This application is a continuation-in-part of U.S. patent application Ser. No. 08/710,169, filed Sep. 12, 1996, and issued Jun. 16, 1998, as U.S. Pat. No. 5,766,118, which claims the benefit of U.S. Provisional Application Ser. No. 60/008,814, filed Dec. 18, 1995. This application is also a continuation-in-part of U.S. patent application Ser. No. 09/056,008, filed Apr. 6, 1998.

FIELD OF THE INVENTION

The invention relates to an exercise apparatus, and more particularly, to an apparatus for exercising the abdominal muscles in contraction and for elongating the spine without placing undue stress on the muscles in the lower back that is lightweight and compact.

BACKGROUND OF THE INVENTION

Situps have long been a popular exercise for strengthening and toning the abdominal muscles. Typically, a person performing a situp lies with the back and feet on a flat surface, and with the knees bent. The person then lifts the head and shoulders in the direction of the knees using the abdominal muscles. The hands may be placed behind the head with the elbows forward so that the elbows touch the knees when the head and shoulders are lifted. The conventional situp, however, places undue stress on the muscles in the lower back, causing discomfort during the exercise and often resulting in an injury.

As a result, the "crunch" style of situp has become a popular alternative to the conventional situp. Crunches are performed in the same manner as conventional situps except that the head and shoulders are lifted only a limited distance so that less range of motion is required by the muscles in the lower back. Accordingly, the undue stress placed on the muscles in the lower back is not eliminated, but only reduced. In addition, crunches do not optimize the exercise benefit received by the abdominal muscles. In particular, the exercise benefit is lost which is obtained by pulling the weight of the head and shoulders the additional distance in the direction of the knees.

A number of weight and "fitness" apparatus have been developed recently for exercising the abdominal muscles. These apparatus, however, for the most part reproduce the same range of motion as the situp and the crunch. Namely, the resistance produced by the apparatus is concentrated in the lower back and the upper body of the person using the apparatus. One such exercise apparatus is disclosed in U.S. Pat. No. 5,098,089 issued Mar. 24, 1992 to Harrington et al. The Harrington exercise apparatus includes a triangular frame for mounting a bed on which the body of the user is supported, knee posts for supporting the knees of the user, and foot posts for receiving the feet and ankles of the user. The frame acts as a fulcrum so that the bed pivots about a transverse axis to permit the user to perform situps with the head elevated above the feet. Accordingly, the user obtains the exercise benefit of the full range of motion of a conventional situp without having to overcome the force of gravity to raise the upper body above the elevation of the feet and knees. Although the Harrington exercise apparatus alleviates a portion of the undue stress placed on the muscles in the lower back, it does not permit the exercise to benefit all of the abdominal muscle groups.

U.S. Pat. No. 5,120,052 issued Jun. 9, 1992 to Evans discloses an abdominal exercise apparatus that develops the abdominal muscles through their entire ranges of motion. The objective of the apparatus is to develop the abdominal muscles not only through contraction, but through increased elongation as well. The apparatus includes a convex arch which engages the upper lumbar and lower thoracic spine in the area of the lower back of the user. The arch permits the user's spine to be supported while allowing the spine to bow outwardly the range that occurs in a normal standing posture. The apparatus further includes an adjustable knee retainer that restrains upward movement of the knees so that the lower back maintains contact with the arch. Accordingly, the range of motion experienced during the situp is increased so that the abdominal muscles are elongated as well as contracted during the exercise. Although the Evans apparatus alleviates a portion of the undue stress placed on the muscles in the lower back and increases the exercise benefit obtained by the muscles in the lower back, it does not permit the exercise to significantly benefit all of the abdominal muscle groups.

U.S. Pat. No. 5,328,435 issued Jul. 12, 1994 to Ricks discloses an exercise apparatus for building stronger stomach muscles. The apparatus includes a pair of foot rests for anchoring the feet of the user in a vertical or inclined orientation. The foot rests immobilize the feet of the user while the user performs a conventional situp. Accordingly, the exercise benefit obtained by the abdominal muscles is somewhat increased by the additional resistance provided by the foot rests. However, the Ricks exercise apparatus places undue stress on the muscles in the lower back, and only some of the abdominal muscles obtain an increased exercise benefit (i.e. the muscles utilized in performing a conventional situp).

Each of the above exercise apparatus place undue stress on the muscles in the lower back and do not permit the exercise to benefit all of the abdominal muscle groups optimally. It is apparent that an exercise apparatus that overcomes one or more of the limitations of the exercise apparatus described above would be advantageous. In particular, it would be advantageous to provide an exercise apparatus which permits the exercise to benefit all of the abdominal muscle groups optimally, and which does not place undue stress on the muscles in the lower back of the user.

U.S. Pat. No. 5,766,118, issued Jun. 16, 1998, to Conner provides an exercise apparatus which permits the exercise to benefit all of the abdominal muscle groups in contraction and does not place undue stress on the muscles in the lower back of the user. The Conner exercise apparatus includes clamping means for securing the apparatus to a vertical surface, at least one elongate, elastic resistance band having opposed ends, one of the opposed ends of the resistance band attached to the clamping means, and a generally triangular resistance harness. The resistance harness includes attachment means for attaching the resistance harness to the other of the opposed ends of the resistance band, an elongate, rigid, resistance bar having opposed ends and a pair of flexible connecting straps, each strap having a first end secured to the resistance bar and a second end secured to the attachment means.

A preferred embodiment of the clamping means of the Conner exercise apparatus includes a U-shaped bracket for temporarily securing the apparatus to a conventional door between the top edge of the door and the portion of the door frame commonly termed the header. Thus, the Conner exercise apparatus may be used anywhere, such as the home and office, that a conventional door and door frame are available. The elongate, rigid, resistance bar, however, limits the portability of the apparatus. In particular, although the Conner exercise apparatus may be easily relocated, it is not well suited for use by individuals who travel using commercial air transportation. In this era in which airlines severely limit the size and weight of baggage, it is essential that an exercise apparatus utilized by individuals who travel frequently be compact and lightweight.

Accordingly, it is an object of the invention to provide an exercise apparatus which permits the exercise to benefit all of the abdominal muscles groups.

It is another object of the invention to provide an exercise apparatus which does not place undue stress of the muscles in the lower back of the user.

It is another, and more particular, object of the invention to provide an exercise apparatus which causes all of the abdominal muscle groups to contract in the direction of the posterior side of the user's body.

It is another object of the invention to provide an exercise apparatus which is compact and lightweight, and thus is convenient for individuals who travel frequently to use, transport and store.

The invention disclosed and shown in the accompanying figures provides such an exercise apparatus including additional features which will be more fully described hereinafter.

SUMMARY OF THE INVENTION

The invention is an exercise apparatus for developing the abdominal muscle groups and elongating the spine of the user without placing undue stress on the muscles in the lower back of the user. The apparatus accomplishes the above objective by providing for a range of motion of at least about 90 degrees with the abdominal muscle groups contracted in the direction of the posterior side of the user's body. The apparatus may be used for toning and conditioning the abdominal muscles, and may be used to rehabilitate the spine while relieving the pressure normally exerted on the muscles in the lower back.

The exercise apparatus includes a clamping means for securing the apparatus to a vertical surface, at least one elongate, elastic resistance band having opposed ends, one of the opposed ends of the resistance band attached to the clamping means, and a flexible resistance harness. The resistance harness includes attachment means for attaching the resistance harness to the other of the opposed ends of the resistance band and a pair of arm slings for receiving the upper arms of the user therein. In a preferred embodiment, the exercise apparatus further includes an adjustment means for adjusting the exercise apparatus vertically to accommodate users of different heights. One end of the adjustment means is attached to the clamping means and the other end is attached to the one end of the resistance band.

The clamping means preferably includes a U-shaped bracket made of a thin, formable material, such as metal or plastic. The inside surface of the bracket engages the top edge of a conventional door so that the exercise apparatus hangs freely from the door under the influence of gravity, but is resisted against downward movement. The U-shaped bracket temporarily secures the apparatus along the top edge of the door between the door and the portion of the door frame commonly termed the header. The bracket includes a base and a pair of spaced apart legs depending outwardly from the base. Preferably, an elongate slot is formed in at least one of the legs of the bracket for receiving one end of the adjustment means.

The resistance band is preferably a thin, narrow, elongate band made of an elastic material, such as rubber, which is formed into a closed loop. As previously described, one end of the resistance band is attached directly to the clamping means or, in a preferred embodiment, to a J-shaped hook provided on the adjustment means as will be described. The other end of the resistance band is attached directly to the resistance harness or, in a preferred embodiment, to a C-shaped hook provided on the resistance harness as will be described. A plurality of resistance bands may be used to increase the cumulative amount of resistance against downward movement provided by the exercise apparatus, or to restrict the range of motion experienced by the user during the exercise.

The resistance harness preferably includes attachment means for attaching the resistance harness to the resistance band, a pair of arm slings for receiving the upper arms of the user therein, at least one connecting strap for connecting the arm slings and a chest strap extending between the arm slings for indicating the location of the arm slings relative to the chest of the user. The attachment means preferably includes a C-shaped hook having a pair of horizontal legs depending outwardly from a vertical leg connecting the horizontal legs. One of the horizontal legs engages the other opposed end of the resistance band and the other horizontal leg engages the connecting strap. The connecting strap is preferably made of a thin, relatively narrow fabric material and may have a loop sewn medially therein for receiving the horizontal leg of the C-shaped hook of the attachment means.

The arm slings are preferably made of a thin, relatively wide fabric material, and most preferably are made of the same fabric material as the connecting strap. The fabric material of each arm sling is formed in a loop that is large enough to comfortably accommodate an upper arm of the user. The ends of the loop are joined together with the connecting strap to form a pair of closed loops separated by the length of the connecting strap. The chest strap is preferably made of a thin, relatively narrow fabric material, and most preferably is made of the same fabric material as the connecting strap and the arm slings. The chest strap is attached to the closed loops formed by the arm slings opposite the connecting strap. The chest strap indicates the location of the arm slings relative to the chest of the user so that the maximum benefit from the exercise can be obtained.

The adjustment means preferably includes a thin, narrow, elongate belt made of a substantially non-elastic material, such as fabric or soft plastic. One end of the belt is threaded first through the elongate slot formed in the bracket of the clamping means, and next through a conventional adjustment buckle so that the length of the belt may be adjusted to vary the height of the exercise apparatus on the door to accommodate users of different heights. The free end of the belt is threaded first through the J-shaped hook for engaging the one end of the resistance band, and next through the opposite side of the adjustment buckle. The elevation of the resistance harness relative to the bracket may be increased or decreased as required by feeding the free end of the belt through the adjustment buckle in a known manner.

The exercise apparatus of the invention exercises the abdominal muscle groups and elongates the spine of the user without placing undue stress on the muscles in the lower back of the user. In a preferred method of use, the exercise apparatus is secured to the door by the clamping means. The user is then seated on a chair or bench with the upper arms extended through the arm slings of the resistance harness. The user adjusts the height of the exercise apparatus (if necessary) using the adjustment means so that the user's back is straight and the resistance band is relaxed, but taut. The adjustment means permits the user to rotate the upper body through a range of motion up to about 90 degrees so that the spine is elongated without the muscles in the lower back having to overcome the influence of gravity to raise the upper body above the elevation of the feet and knees.

To begin the exercise, the user pulls the arm slings of the resistance harness in the direction of the pelvis using the abdominal muscles while tilting the pelvis to bow the lower back outwardly so that the abdominal muscle groups are contracted and the spine is elongated. The user holds this position for between about 5 and about 30 seconds, and preferably for about 20 seconds. The user then relieves the downward pressure on the arm slings of the resistance harness so that the tension in the resistance band is relaxed. The exercise is repeated as many times as desired, typically at least 2 sets of 10 repetitions each.

A particular advantage of the exercise apparatus of the present invention is that it is portable. The clamping means, resistance bands, J-shaped hook, C-shaped hook, resistance harness and adjustment means are each made of a lightweight material such as cast aluminum, rubber and fabric. In particular, the fabric material of the arm slings, connecting strap and chest strap of the resistance harness, and the belt of the adjustment means permit the exercise apparatus to be folded compactly. Accordingly, the resistance harness and adjustment means can be placed along with the clamping means, resistance bands, J-shaped hook and C-shaped hook into a compact travel case, such as a fabric pouch having a drawstring closure, for convenient use, transport and storage. Thus, individuals who travel frequently can take full advantage of the benefits of the exercise apparatus on a daily basis even when travelling away from the home or office.

BRIEF DESCRIPTION OF THE DRAWINGS

While some of the objects and advantages have been stated, others will become even more apparent as the preferred embodiments of the invention are described in connection with the accompanying drawings in which.

DETAILED DESCRIPTION OF THE PREFERRED EMBODIMENTS

Figure 1:
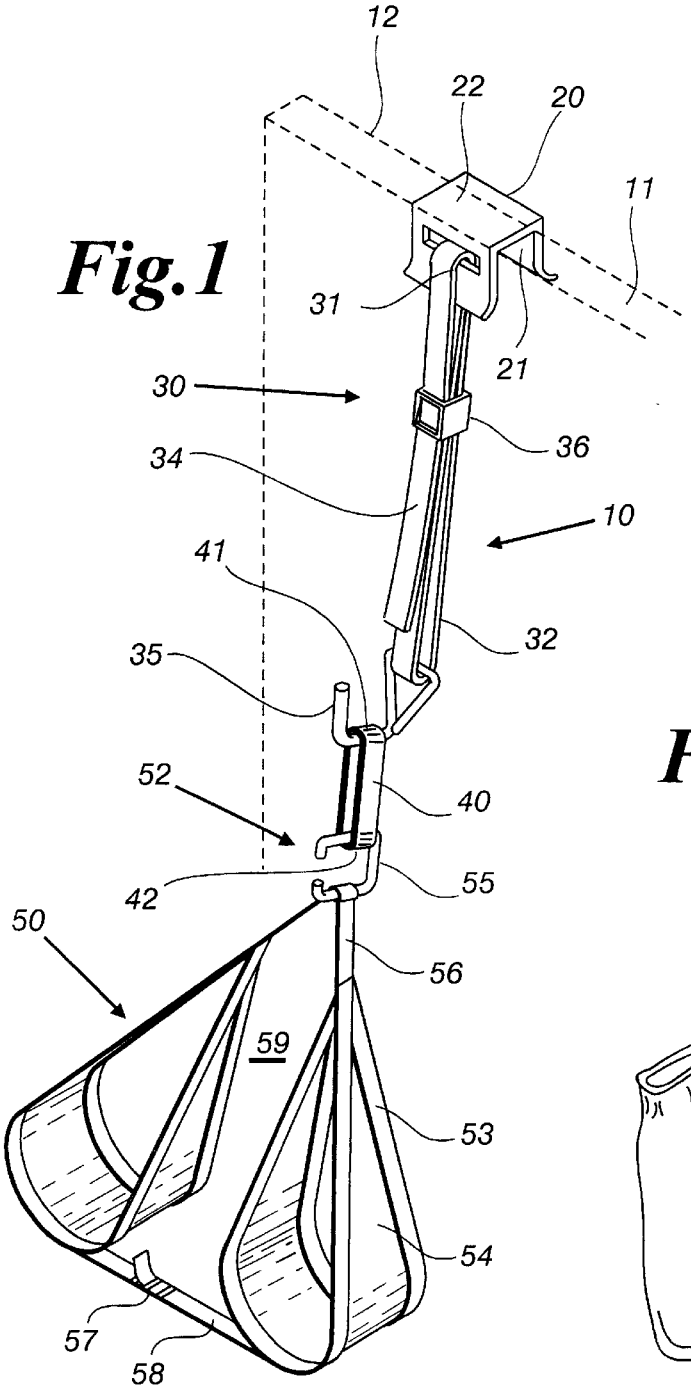
FIG. 1 is an environmental perspective view of an exercise apparatus according to the invention.

Referring now to the drawings, wherein like numerals indicate like elements, FIG. 1 is an environmental view of a preferred embodiment of an exercise apparatus, indicated generally at 10, according to the invention. The exercise apparatus 10 enables a user to develop the abdominal muscle groups and elongate the spine without placing undue stress on the muscles in the lower back. The exercise apparatus 10 provides for a range of motion of at least about 90 degrees with the abdominal muscle groups contracted in the direction of the posterior side of the user's body. Thus, the apparatus 10 may be used for toning and conditioning the abdominal muscles, and may be used to rehabilitate the spine while relieving the pressure normally exerted on the muscles in the lower back.

The apparatus 10 comprises clamping means 20 for securing the exercise apparatus 10 to a conventional door, at least one resistance band 40 and a resistance harness 50. One end 41 of the resistance band 40 is attached directly to the clamping means 20 or, as in the preferred embodiment illustrated in FIG. 1, is attached to adjustment means 30 for adjusting the exercise apparatus vertically to accommodate users of different heights. The other end 42 of the resistance band is attached to the resistance harness 50. When adjustment means 30 is utilized, one end 31 is attached directly to the clamping means 20, and the other end 32 of the adjustment means is attached to end 41 of the resistance band 40.

The clamping means 20 secures the exercise apparatus 10 to a conventional door 12, indicated by the broken lines in FIG. 1. The clamping means 20 preferably comprises a U-shaped bracket 22 made of a thin, formable material, such as metal or plastic. Most preferably, the bracket 22 is made of cast aluminum for to maximize its strength to weight ratio. The inside surface 21 of the bracket 22 engages the top edge 11 of the door 12 so that the exercise apparatus 10 hangs freely from the door under the influence of gravity, but is resisted against downward movement by the bracket 22. The bracket 22 preferably comprises a base and a pair of spaced apart legs depending outwardly from the base. An elongate slot is formed in at least one of the legs of the bracket 22 for receiving end 31 of adjustment means 30. A clamping screw (not shown) may be provided through an aperture formed opposite the elongate slot to permit the bracket 22 to be used with a door 12 which is less than standard thickness.

The resistance band 40 preferably comprises a thin, narrow, elongate band made of an elastic material, such as rubber, which is formed into a closed loop. As previously described, end 41 of the resistance band 40 is attached directly to clamping means 20, or alternatively to adjustment means 30. As shown in FIG. 1, end 41 of resistance band 40 is attached to a J-shaped hook 35 provided on adjustment means 30. The end 42 of the resistance band 40 is attached directly to the resistance harness 50 or, as shown in FIG. 1, to a C-shaped hook 55 provided on the resistance harness. The elastic resistance band 40 provides increasing resistance as the resistance harness 50 is pulled downward and the resistance band is extended.

A plurality of resistance bands 40 may be used to increase the cumulative amount of resistance against downward movement provided by the exercise apparatus 10, or to restrict the range of motion experienced by the user during the exercise. Thus, as the abdominal muscles of the user strengthen, additional resistance bands 40 may be used to increase the exercise benefit obtained by the abdominal muscle groups. Preferably the plurality resistance bands 40 each have the same length and elasticity. However, a plurality of resistance bands 40 may be provided having different lengths and/or elasticities so that a user may also vary the amount of extension provided by the resistance bands 40, and thus the amount of contraction experienced by the abdominal muscle groups.

The resistance harness 50 preferably comprises attachment means 52 for attaching the resistance harness to the resistance band 40, a pair of arm slings 54 for receiving the upper arms of the user therein, at least one connecting strap 56 for connecting the arm slings and a chest strap 58 extending between the arm slings for indicating the location of the arm slings relative to the chest of the user. The attachment means 52 preferably comprises the previously mentioned C-shaped hook 55 which has a pair of horizontal legs depending outwardly from a vertical leg connecting the horizontal legs. One of the horizontal legs engages the end 42 of the resistance band 40 and the other horizontal leg engages the connecting strap 56.

The connecting strap 56 is preferably made of a thin, relatively narrow fabric material and may have a loop sewn medially therein for receiving the horizontal leg of the C-shaped hook 55 of the attachment means 52. The arm slings 54 are preferably made of a thin, relatively wide fabric material, and most preferably are made of the same fabric material as the connecting strap 56. The fabric material of each arm sling 54 is formed in a loop that is large enough to comfortably accommodate an upper arm of the user. If desired, the edges 53 of the loops may be reinforced with elastic to prevent the fabric material of the arm slings 54 from fraying. The ends of the loop are joined together with the connecting strap 56 to form a pair of closed loops separated by the length of the connecting strap.

The chest strap 58 is preferably made of a thin, relatively narrow fabric material, and most preferably is made of the same fabric material as the connecting strap 56 and the arm slings 54. The chest strap 58 is attached to the closed loops formed by the arm slings 54 opposite the connecting strap 56. The chest strap 58 indicates the location of the arm slings 54 relative to the chest of the user so that the maximum benefit from the exercise can be obtained. Preferably, the chest strap 58 is provided with a conventional adjustment buckle 57 for adjusting the length of the chest strap, and thus the limit of the distance between the arm slings 54. For best results, the elbows of the user should be positioned at the level of the user's chest and the length of the chest strap 58 should be adjusted using buckle 57 such that the elbows of the user extend comfortably beyond the user's chest with the arms folded in front of the chest.

The adjustment means 30 preferably comprises a thin, narrow, elongate belt 34 made of a substantially non-elastic material, such as fabric or soft plastic. One end of the belt 34 is threaded first through the elongate slot formed in bracket 22 of clamping means 20, and next through an adjustment buckle 36. The end of the belt 34 is then secured to itself in a conventional manner, such as by sewing, stapling or riveting. The free end of the belt 34 is threaded first through the eyelet of the J-shaped hook 35 for engaging the end 41 of the resistance band 40, and next through the opposite side of adjustment buckle 36. Accordingly, adjustment means 30 connects the clamping means 20 to the resistance band 40 such that the length of the belt may be adjusted to vary the height of the exercise apparatus 10 on the door 12 to accommodate users of different heights. The elevation of the arm slings 54 of the resistance harness 50 relative to the bracket 22 may be increased or decreased as required by feeding the free end of the belt 34 through the adjustment buckle 36 in a known manner.

The exercise apparatus 10 permits a user to exercise all of the abdominal muscle groups and elongate the spine of the user without placing undue stress on the muscles in the lower back. As previously described, the exercise apparatus 10 is secured to a conventional door 12 by the clamping means 20. The user is then seated on a bench or chair facing the door and the exercise apparatus 10. If necessary, the user adjusts the vertical location of the exercise apparatus 10 using the adjustment means 30 so that the user's back is straight and the resistance band 40 is relaxed, but taut. The user extends the upper arms through the arm slings 54 with the chest strap 58 adjacent the chest, the elbows spread apart as far as possible and the arms folded in front of the chest. Thus, the resistance harness 50 defines a triangular opening 59 formed by the arm slings 54, the connecting strap 56 and the chest strap 58.

To begin the exercise, the user pulls the arm slings 54 of the resistance harness 50 in the direction of the pelvis using the abdominal muscles while tilting the pelvis to bow the lower back outwardly so that the abdominal muscle groups are contracted and the spine is elongated. The user holds this position for between about 5 and about 30 seconds, and preferably for about 20 seconds. The resistance in the opposite direction provided by extension of the resistance band 40 exercises all of the abdominal muscles groups in contraction as opposed to extension. The user then relieves the downward pressure on the arm slings 54 of the resistance harness 50 so that the tension in the resistance band 40 is relaxed. This preferred method of using the exercise apparatus 10 is particularly beneficial to increase the degree of contraction of the abdominal muscle groups without placing undue stress on the muscles in the lower back. The exercise is repeated as many times as desired, typically at least 2 sets of 10 repetitions each.

Figure 2:
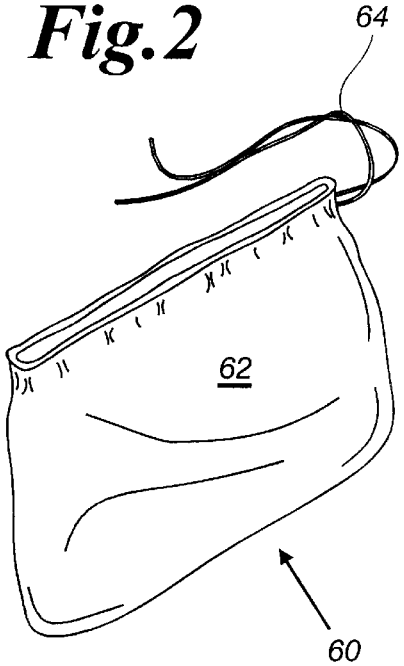
FIG. 2 illustrates a preferred embodiment of a compact travel case which may be used by individuals who travel frequently to conveniently transport the exercise apparatus of FIG. 1.

A particular advantage of the exercise apparatus 10 is that it is portable. The clamping means 20, resistance bands 40, J-shaped hook 35, C-shaped hook 55, resistance harness 50 and adjustment means 30 are each made of a lightweight material such as cast aluminum, rubber and fabric. In particular, the fabric material of the arm slings 54, connecting strap 56 and chest strap 58 of the resistance harness 50, and the belt 34 of the adjustment means 30 permit the exercise apparatus 10 to be folded compactly. Thus, the resistance harness 50 and adjustment means 30 can be placed along with the clamping means 20, resistance bands 40, J-shaped hook 35 and C-shaped hook 55 into a compact travel case for convenient use, transport and storage. A preferred embodiment of a compact travel case 60 comprising a fabric pouch 62 having a drawstring closure 64 is illustrated in FIG. 2. The lightweight exercise apparatus 10 is compact enough to be carried in a user's luggage when traveling away from the home or office. Accordingly, individuals who travel frequently can take full advantage of the benefits of the exercise apparatus 10 on a daily basis even when travelling away from the home or office.

From the foregoing detailed description, it is readily apparent that the exercise apparatus 10 and the method of using the exercise apparatus disclosed herein permit a user to exercise all of the abdominal muscle groups and elongate the spine without placing undue stress on the muscles in the lower back. The exercise apparatus 10 increases the range of motion, and increases the degree of contraction of the abdominal muscle groups experienced by the user during the exercise. Further, the exercise apparatus 10 is lightweight and compact such that it can be placed into a compact travel case 60 and carried in a user's luggage when traveling away from the home or office so that individuals who travel frequently can take full advantage of the benefits of the exercise apparatus even when travelling away from the home or office.

It is to be understood that the preferred embodiments shown and described herein are merely illustrative of the best mode of the invention and the principals thereof. Thus, it is expected that modifications and additions may be made to the exercise apparatus by those skilled in the art without departing from the spirit and scope of the invention, which is therefore understood to be limited only by the scope of the appended claims.

That which is claimed is:

1. An apparatus for exercising the abdominal muscles comprising:

clamping means for securing the apparatus to a conventional door;

at least one elongate, elastic resistance band attached to said clamping means; and a flexible resistance harness attached to said at least one resistance band, said resistance harness comprising a pair of arm slings made of a thin, relatively wide material, each of said arm slings formed in a closed loop defining an opening therethrough;

a connecting strap made of a thin, relatively narrow material and having opposed ends, each of said opposed ends of said connecting strap attached to one of said pair of arm slings such that said connecting strap connects said pair of arm slings; and a chest strap made of a thin, relatively narrow material and having opposed ends, each of said opposed ends of said chest strap attached to one of said pair of arm slings opposite said connecting strap;

wherein the exercise apparatus is compact and lightweight such that it is convenient for individuals who travel frequently to use, transport and store.

2. An apparatus according to claim 1 wherein said chest strap comprises an adjustment buckle for adjusting the length of said chest strap and thus the limit of the distance between said arm slings when the elbows of the user extend comfortably beyond the user's chest with the arms folded in front of the chest.

3. An apparatus according to claim 1 wherein said resistance harness further comprises attachment means for attaching said resistance harness to the other of the opposed ends of said at least one resistance band.

4. An apparatus according to claim 3 wherein said attachment means comprises a C-shaped hook having a pair of horizontal legs depending outwardly from a vertical leg connecting the horizontal legs.

5. An apparatus according to claim 1 further comprising adjustment means for adjusting the location of said resistance harness vertically relative to said clamping means to accommodate users of different heights, said adjustment means having opposed ends, one of said opposed ends attached to said clamping means and the other of said opposed ends attached to said at least one resistance band.

6. An apparatus according to claim 5 wherein said adjustment means comprises a thin, relatively narrow, elongate belt made of a fabric material and having opposed ends, one of said opposed ends of said belt threaded first through an elongate slot provided in said clamping means and then through an adjustment buckle so that the length of said belt may be adjusted to vary the location of said resistance harness vertically relative to said clamping means to accommodate users of different heights.

7. An apparatus according to claim 6 wherein said adjustment means comprises a J-shaped hook having an eyelet for receiving the other of said opposed ends of said belt therethrough and a hook portion for receiving said one end of said resistance band thereon.

8. An apparatus according to claim 1 wherein said at least one resistance band comprises a plurality of resistance bands for varying the cumulative resistance which a user must overcome when exercising the abdominal muscles.

9. An apparatus for exercising the abdominal muscles comprising:

clamping means for securing the apparatus to a conventional door, said clamping means comprising a U-shaped bracket having an elongate slot formed therein;

adjustment means comprising a thin, relatively narrow, elongate belt made of a fabric material and having opposed ends, one of said opposed ends of said belt threaded first through the elongate slot provided in said clamping means and then through an adjustment buckle so that the length of said belt may be adjusted, the other of said opposed ends of said belt threaded through an eyelet provided in a J-shaped hook;

at least one elongate, elastic resistance band having opposed ends, one of the opposed ends of said resistance band attached to said J-shaped hook of said adjustment means; and a flexible resistance harness, said resistance harness comprising attachment means for attaching said resistance harness to the other of the opposed ends of said at least one resistance band, said attachment means comprising a C-shaped hook having a pair of horizontal legs depending outwardly from a vertical leg connecting the horizontal legs;

a pair of arm slings made of a thin, relatively wide fabric material, each of said arm slings formed in a closed loop defining an opening therethrough;

a connecting strap made of a thin, relatively narrow fabric material and having opposed ends, each of said opposed ends of said connecting strap attached to one of said pair of arm slings such that said connecting strap connects said pair of arm slings; and a chest strap made of a thin, relatively narrow fabric material and having opposed ends, each of said opposed ends of said chest strap attached to one of said pair of arm slings opposite said connecting strap;

wherein the exercise apparatus is compact and lightweight such that it is convenient for individuals who travel frequently to use, transport and store.

10. An apparatus according to claim 9 wherein said at least one resistance band comprises a plurality of resistance bands for varying the cumulative resistance which a user must overcome when exercising the abdominal muscles.

11. A method of exercising the abdominal muscles using the apparatus of claim 1, said method comprising the steps of:

securing the apparatus to a conventional door using the clamping means;

if necessary, adjusting the vertical location of the resistance harness of the apparatus relative to said clamping means so that the back is straight and the at least one resistance band is relaxed, but taut;

extending the upper arms through the openings defined by the arm slings of the resistance harness with the elbows spread apart as far as possible and the arms folded in front of the chest;

pulling the arm slings of the resistance harness in the direction of the pelvis using the abdominal muscles while tilting the pelvis to bow the lower back outwardly so that the abdominal muscle groups are contracted and the spine is elongated;

holding this position for a predetermined period of time;

relieving the downward pressure on the arm slings of the resistance harness so that the tension in the at least one resistance band is relaxed.

* * * * *